US007621611B2

(12) United States Patent
Fukasawa

(10) Patent No.: US 7,621,611 B2
(45) Date of Patent: Nov. 24, 2009

(54) LIQUID DELIVERY DEVICE AND LIQUID DELIVERY METHOD

(75) Inventor: Kenji Fukasawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 42 days.

(21) Appl. No.: 12/137,395

(22) Filed: Jun. 11, 2008

(65) Prior Publication Data

US 2008/0309700 A1 Dec. 18, 2008

(30) Foreign Application Priority Data

Jun. 14, 2007 (JP) ..... 2007-157878

(51) Int. Cl.
*B41J 2/205* (2006.01)

(52) U.S. Cl. ..... 347/15; 347/43

(58) Field of Classification Search ..... 347/12, 347/13, 15, 40, 42, 43, 44, 47
See application file for complete search history.

(56) References Cited

U.S. PATENT DOCUMENTS 6,659,583 B2 * 12/2003 Fujimori ..... 347/15

FOREIGN PATENT DOCUMENTS

JP 2007-068202 3/2007

* cited by examiner

*Primary Examiner*—Juanita D Stephens
(74) *Attorney, Agent, or Firm*—Hogan & Hartson LLP

(57) ABSTRACT

A liquid delivery device includes a first nozzle row that has a plurality of nozzles in a predetermined direction and delivers a first liquid. A second nozzle row has a plurality of nozzles in the predetermined direction and delivers a second liquid having a concentration different from that of the first liquid. A controller forms first dots on a medium at predetermined intervals by delivering the first liquid from the plural nozzles of the first nozzle row without using a part of the nozzles of the first nozzle row, and forms second dots on the medium at the predetermined intervals by delivering the second liquid from the plural nozzles of the second nozzle row without using a part of the nozzles of the second nozzle row such that each of the second dots is located between the first dots in the predetermined direction.

8 Claims, 12 Drawing Sheets

FIG. 5A
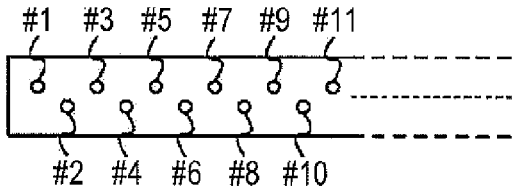
FIG. 5B
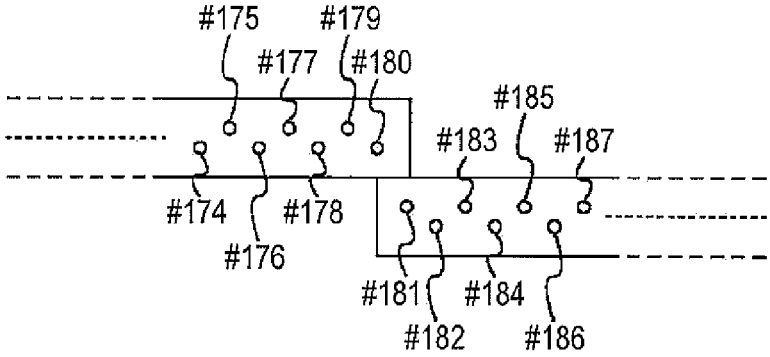
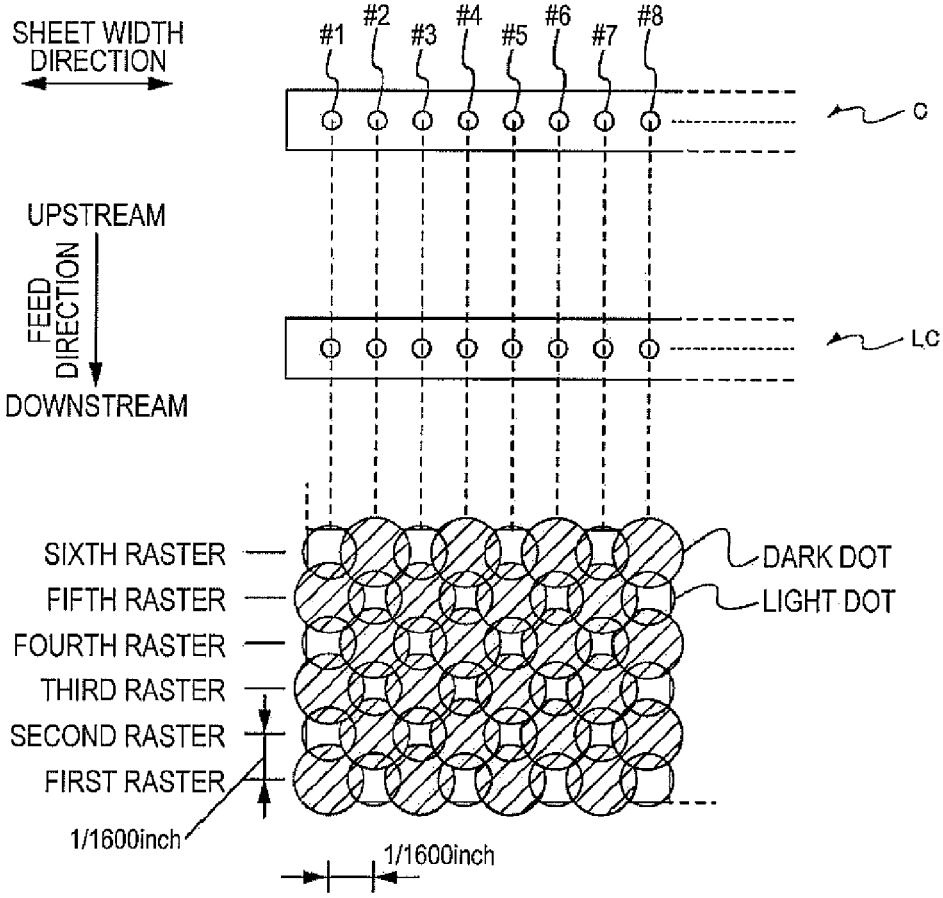
FIG. 6

LIQUID DELIVERY DEVICE AND LIQUID DELIVERY METHOD

CROSS REFERENCE TO RELATED APPLICATIONS

This application claims the benefit under 35 USC 119 of Japanese patent application no. 2007-157878, filed on Jun. 14, 2007, the contents of which are incorporated herein by reference.

BACKGROUND

1. Technical Field

The present invention relates to a liquid delivery device and a liquid delivery method.

2. Related Art

An ink jet type printer is a liquid delivery device that delivers liquid (such as ink) onto a medium (such as paper, fabric, and OHP sheet). A conventional ink jet type printer alternately repeats a dot forming process for shifting a carriage and delivering ink drops from a head and a feeding process for feeding a sheet so as to print an image constituted by dots on the sheet. One type of ink jet type printer is a line printer that does not shift a head by using a carriage but uses a head having a length equivalent to the sheet width (see JP-A-2007-68202).

In a line printer, there is a possibility that delivery of ink from one nozzle influences delivery of ink from nozzles disposed adjacent to the one nozzle (adjoining nozzles) In this case, the amount of ink delivered from the one nozzle varies depending on whether the adjoining nozzles deliver ink or not. One method for avoiding this situation controls ink delivery from the adjoining nozzles such that ink delivery is stopped therefrom at the time of ink supply from the one nozzle.

According to this ink delivery control method, ink needs to be applied to the medium with no clearance produced to such an extent that the base of the medium becomes invisible at the time of the highest gradient display. It is possible to use a larger number of nozzle rows so that ink can be applied with no clearance, but such addition of nozzle rows raises the manufacturing cost.

SUMMARY

The present invention provides a technology that achieves both reduction of the nozzle row number and application of liquid to a medium with no clearance.

A liquid delivery device according to a first aspect of the invention includes: a first nozzle row which has a plurality of nozzles in a predetermined direction and delivers first liquid; a second nozzle row which has a plurality of nozzles in the predetermined direction and delivers second liquid having concentration different from that of the first liquid; and a controller which forms first dots on a medium at predetermined intervals by delivering the first liquid from the plural nozzles of the first nozzle row without using a part of the nozzles of the first nozzle row, and forms second dots on the medium at the predetermined intervals by delivering the second liquid from the plural nozzles of the second nozzle row without using a part of the nozzles of the second nozzle row such that each of the second dots is located between the first dots in the predetermined direction.

Other aspects and advantages of the invention will be apparent from the following disclosure and the accompanying drawings.

BRIEF DESCRIPTION OF THE DRAWINGS

The invention will be described with reference to the accompanying drawings, wherein like numbers reference like elements.

FIGS. 5A and 5B illustrate nozzle arrangements.

FIG. 6 illustrates-a dot formation method according to a first embodiment of the invention.

DESCRIPTION OF EXEMPLARY EMBODIMENTS

Figure 1:
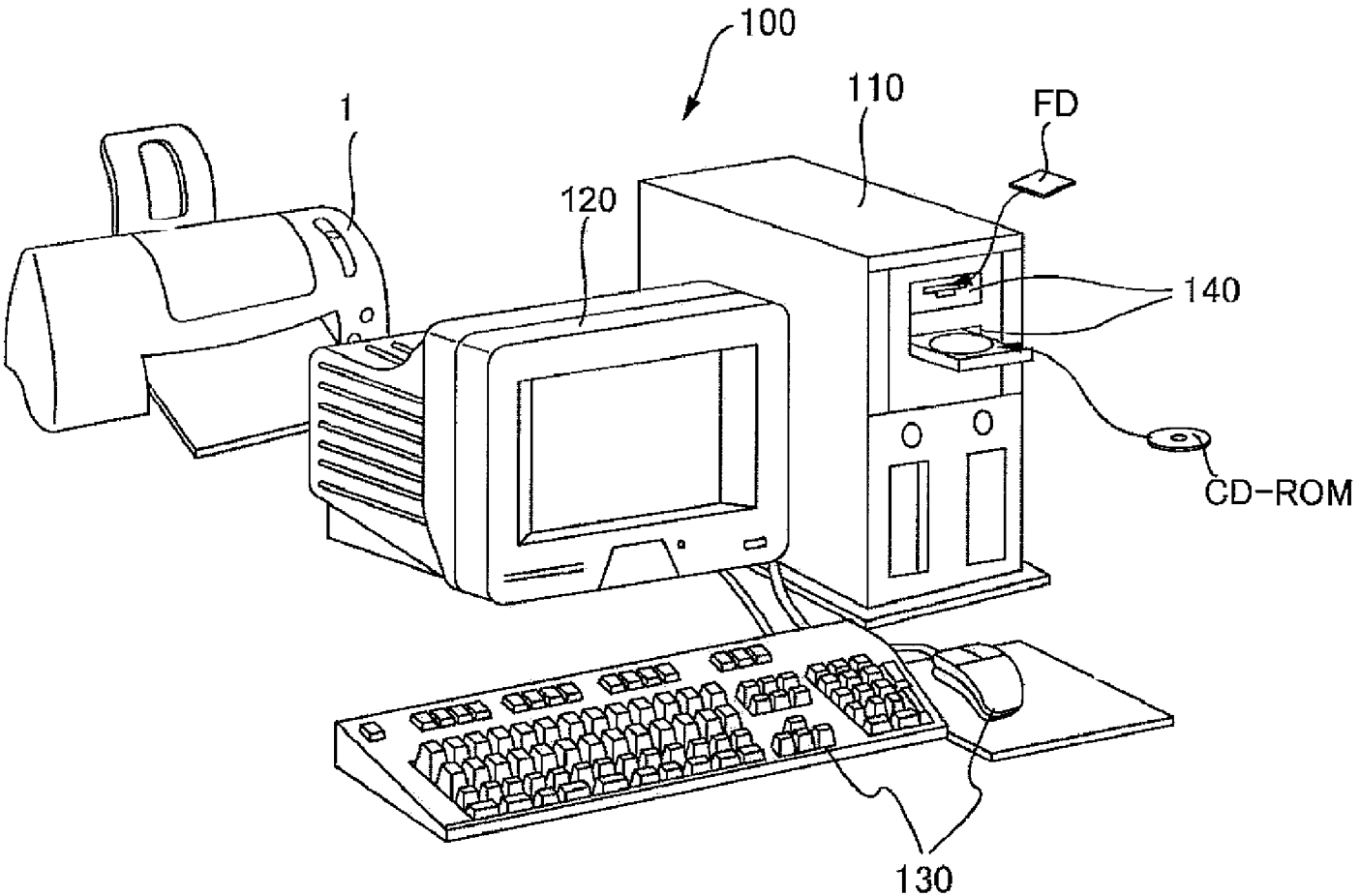
FIG. 1 is a perspective view of a printing system according to the present invention.

Embodiments of the invention are explained by the disclosure herein and the accompanying drawings A liquid delivery device according to an embodiment of the invention includes: a first nozzle row that has a plurality of nozzles in a predetermined direction and delivers first liquid; a second nozzle row that has a plurality of nozzles in the predetermined direction and delivers second liquid having concentration different from that of the first liquid; and a controller that forms first dots on a medium at predetermined intervals by delivering the first liquid from the plural nozzles of the first nozzle row without using a part of the nozzles of the first nozzle row, and forms second dots on the medium at the predetermined intervals by delivering the second liquid from the plural nozzles of the second nozzle row without using a part of the nozzles of the second nozzle row such that each of the second dots is located between the first dots in the predetermined direction.

According to this liquid delivery device, liquid can be applied on the medium with no clearance produced by a reduced number of nozzle rows.

When liquid is delivered from one nozzle, the liquid is preferably not delivered from nozzles disposed adjacent to the nozzle in the liquid delivery device. In this manner, liquid delivery from the one nozzle is not influenced by liquid delivery from the adjoining nozzles.

When one nozzle forms a dot on a pixel, the one nozzle preferably does not form a dot on a pixel opposed to the one nozzle next in the liquid delivery device. In this manner, the printing speed increases.

When the first dot is formed on a pixel by one nozzle of the first nozzle row, the second dot is preferably formed on a pixel opposed to the one nozzle next in the liquid delivery device. In this manner, liquid can be applied to the medium without clearance.

In the liquid delivery device, the first liquid is preferably darker than the second liquid, and the first dots are preferably larger than the second dots. In this manner, both reduction of conspicuousness of particles in the light part and representation of the deep and dark part can be easily achieved.

When the darkest color is represented by the first liquid and the second liquid, both the first dots and the second dots are preferably disposed in a checkered pattern such that each second dot is not formed on a pixel where the first dot is formed in the liquid delivery device. In this manner, liquid delivery from the one nozzle is not influenced by liquid delivery from the adjoining nozzles, and also the printing speed increases.

In the liquid delivery device, the following structure is preferable. The first nozzle row delivers dark cyan ink to form dark cyan dots on the medium. The second nozzle row delivers light cyan ink to form light cyan dots on the medium. The liquid delivery device has a third nozzle row which delivers dark magenta ink to form dark magenta dots on the medium, and a fourth nozzle row which delivers light magenta ink to form light magenta dots on the medium. Each of the light magenta dots is disposed between the light cyan dots. In this manner, particles become unnoticeable, and the image quality improves.

A liquid delivery method according to a second embodiment of the invention includes: delivering a first liquid from a first nozzle row which has a plurality of nozzles in a predetermined direction; delivering a second liquid having a concentration different from that of the first liquid from a second nozzle row which has a plurality of nozzles in the predetermined direction; and forming first dots on a medium at predetermined intervals by delivering the first liquid from the plural nozzles of the first nozzle row without using a part of the nozzles of the first nozzle row; and forming second dots on the medium at the predetermined intervals by delivering the second liquid from the plural nozzles of the second nozzle row without using a part of the nozzles of the second nozzle row such that each of the second dots is located between the first dots in the predetermined direction.

According to this liquid delivery method, liquid can be applied on the medium with no clearance produced by a reduced number of nozzle rows.

Structure of Printing System

A printing system according to an embodiment of the invention is now described with reference to the drawings. In the following description, a computer program, a recording medium on which the computer program is recorded, and others are included as examples of the invention.

FIG. 1 is a perspective view of a printing system 100. Printing system 100 includes a printer 1, a computer 110, a display device 120, an input device 130, and a recording and reproducing device 140. The printer 1 is a printing device that prints an image on a medium such as paper, fabric, and film. The computer 110 is connected with the printer 1 in such a manner as to communicate with the printer 1, and outputs printing data corresponding to an image to be printed to the printer 1.

A printer driver is installed in the computer 110. The printer driver is a program that commands the display device 120 to display a user interface and to convert image data outputted from an application program into printing data. The printer driver is recorded on a recording medium readable by a computer such as flexible disk FD and CD-ROM. Alternatively, the printer driver may be downloaded to the computer 110 via the Internet. This program is constituted by codes for providing various functions.

The "printing device" herein refers to a device that prints an image on a medium, such as the printer 1. The "printing control device" refers to a device that controls the printing device such as the computer in which the printer driver is installed. The "printing system" refers to a system that includes at least the printing device and the printing control device.

Structure of Printer

Structure of Ink Jet Printer

Figure 2:
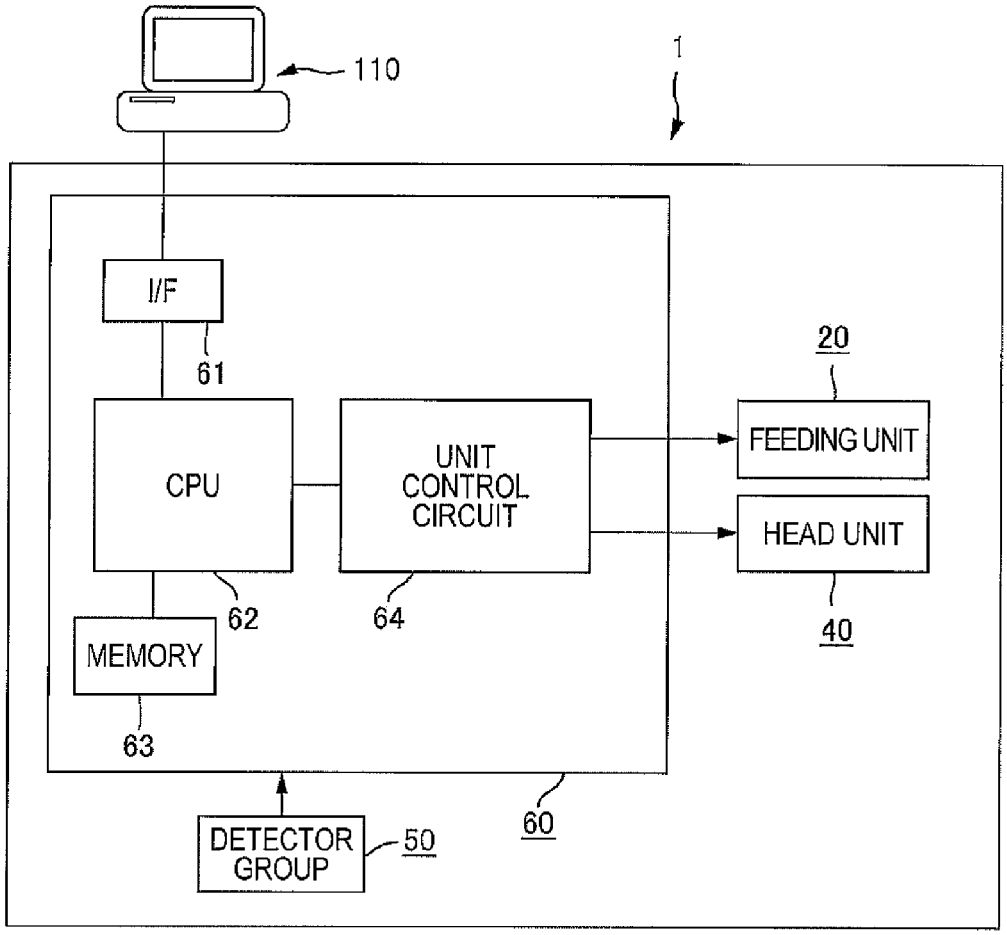
FIG. 2 is a block diagram of a printer according to the present invention.
Figure 3A:
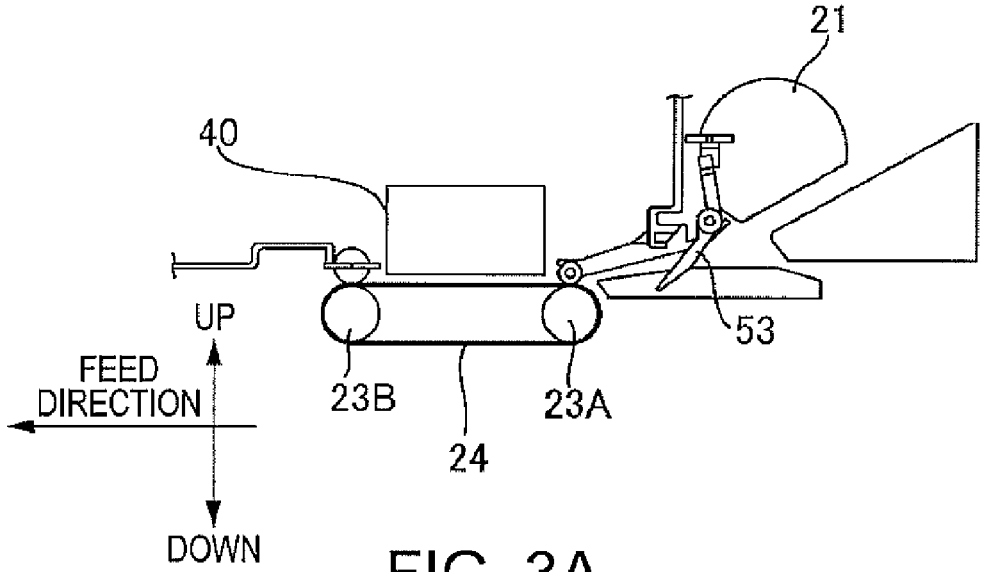
FIG. 3A is a cross-sectional view of the printer.
Figure 3B:
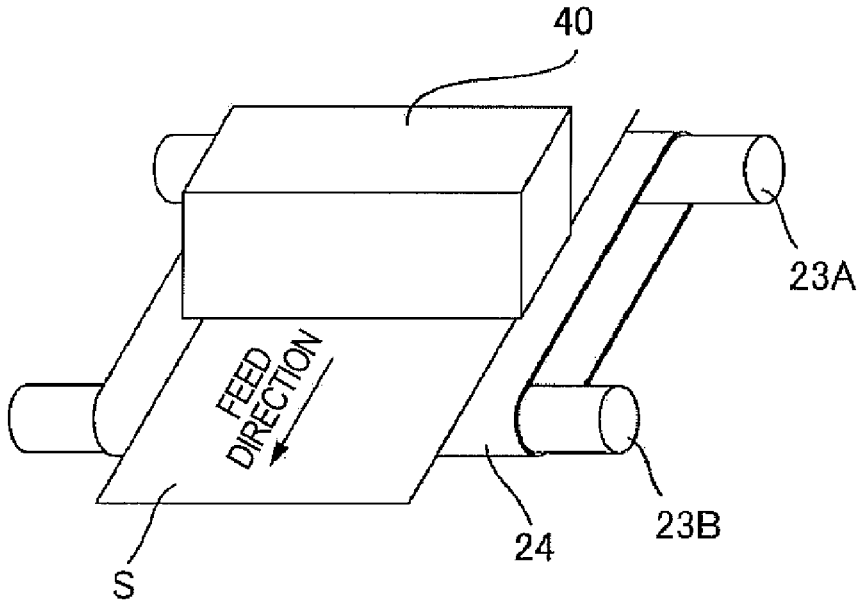
FIG. 3B is a perspective view illustrating a feeding operation and a dot forming operation of the printer.

FIG. 2 is a block diagram of the printer 1. FIG. 3A is a cross-sectional view of the printer 1. FIG. 3B is a perspective view illustrating a feeding process and a dot forming process performed by the printer 1. A basic structure of a line printer as an example of the printer according to this embodiment is now described.

The printer 1 according to this embodiment includes a feeding unit 20, a head unit 40, a detector group 50, and a controller 60. The printer 1 having received printing data from the computer 110 as an external device controls feeding unit 20 and head unit 40 by using the controller 60. The controller 60 controls these units based on printing data received from the computer 110, and prints an image on a sheet. The condition inside the printer 1 is monitored by the detector group 50 which outputs detection results to the controller 60. The controller 60 controls feeding unit 20 and head unit 40 based on the detection results outputted from the detector group 50.

The feeding unit 20 feeds a medium (such as sheet S) in a predetermined direction (hereinafter referred to as a feed direction). The feeding unit 20 has a sheet supply roller 21, a feed motor (not shown), upstream feed roller 23A and downstream feed roller 23B, and a belt 24. The sheet supply roller 21 supplies a sheet inserted through a sheet insertion hole to the inside of the printer 1. Revolution of the feed motor rotates the upstream feed roller 23A and the downstream feed roller 23B, and the belt 24 rotates accordingly. The sheet S supplied by the sheet supply roller 21 is carried to a printing area for printing (an area opposed to the head). The sheet S carried by the belt 24 shifts in the feed direction from the head unit 40. The sheets having passed the printing area are discharged to the outside by the belt 24. The sheet S during feeding is absorbed on the belt 24 by electrostatic force or by vacuum.

The head unit 40 delivers ink onto the sheet S. The head unit 40 forms dots on the sheet S by delivering ink onto the sheet S during feeding to print an image on the sheet S. The printer in this embodiment is a line printer having the head unit 40 which forms dots throughout the sheet width at a time. The detailed structure of the head unit 40 will be described later.

The detector group 50 contains a rotary type encoder (not shown), a sheet detection sensor 53, and other detectors. The rotary type encoder detects revolution amounts of the upstream feed roller 23A and downstream feed roller 23B. It is possible to detect the feed quantity of the sheet S based on the detection result of the rotary type encoder. The sheet detection sensor 53 detects the position of the leading end of the sheet during feeding.

The controller 60 is a control unit for controlling the printer (control section). The controller 60 has an interface 61, a CPU 62, a memory 63, and a unit control circuit 64. The interface 61 allows data transmission and reception between the computer 110 as the external device and the printer 1. The CPU 62 is a processing unit for controlling the overall operation of the printer. The memory 63 secures a region or a working region for storing the program performed by the CPU 62, and includes storing elements such as RAM and EEPROM. The CPU 62 controls the respective units via the unit control circuit 64 under the control of the program stored in the memory 63. Particularly, the controller 60 forms dots having a dot arrangement to be described later by controlling the feeding operation of the feeding unit 20 and the ink delivery operation (dot forming operation) of the head unit 40.

Structure of Head Unit 40

Figure 4A:
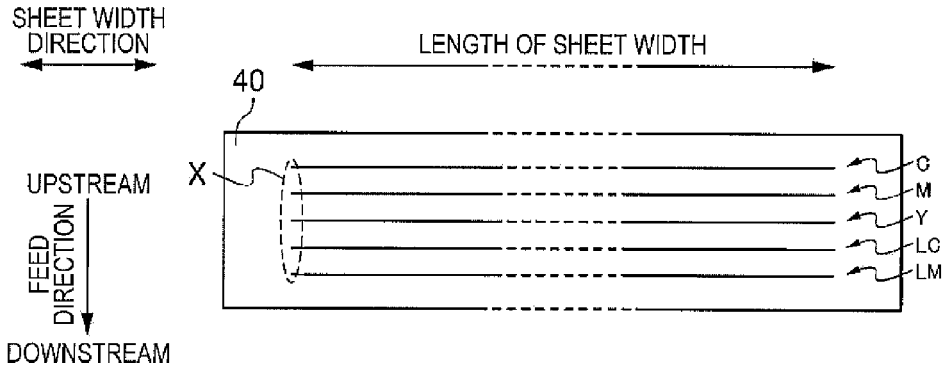
FIG. 4A illustrates a plurality of nozzle rows arranged on a lower surface of a head unit of the printer as viewed from above through the lower surface.

FIG. 4A illustrates a plurality of nozzle rows arranged on the lower surface of the head unit 40 as viewed from above through the lower surface. There are five nozzle rows on the lower surface of the head unit 40. The five nozzle rows are a adark cyan nozzle row (C), a dark magenta nozzle row (M), a yellow nozzle rows (Y), a light cyan nozzle row (LC), and a light magenta nozzle row (LM) disposed in this order from the upstream side in the feed direction. The length in the sheet width direction of each nozzle row corresponds to the length of the sheet width of A4 size.

Figure 4B:
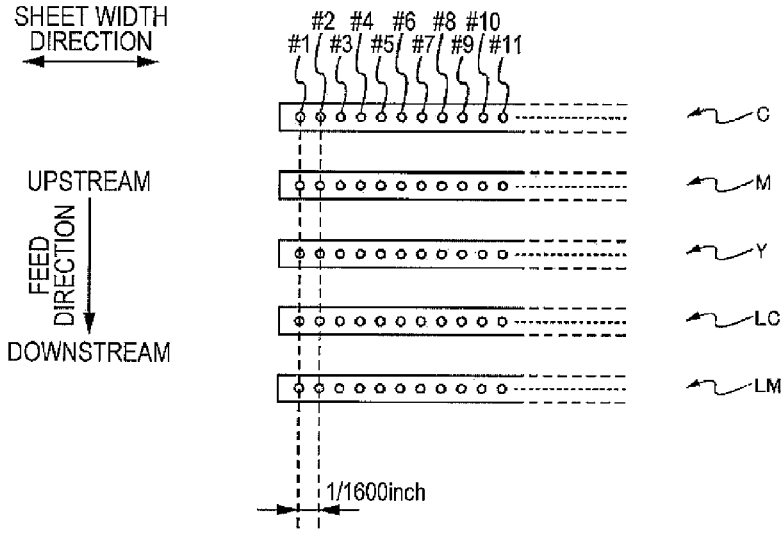
FIG. 4B illustrates an enlarged area X surrounded by the dotted line of FIG. 4A, showing the left ends of the nozzle rows in respective colors.

FIG. 4B illustrates an enlarged portion X surrounded by the dotted line of FIG. 4A, showing the enlarged left ends of the respective nozzle rows. As illustrated in FIG. 4B, each of the nozzle rows has a plurality of nozzles arranged in the sheet width direction with a predetermined nozzle pitch (1/1600 inch in this embodiment). Each of the nozzles has a heater (not shown) for generating heat such that ink can be delivered from the nozzle by the generated heat. Numbers are given to the nozzles of each nozzle row in the order from the left of FIG. 4B. As illustrated in FIG. 4B, the positions of the nozzles #1 of the nozzle rows for the respective colors are aligned in the sheet width direction. The positions of other nozzles having the same numbers in the nozzle rows are similarly alighted in the sheet width direction.

FIGS. 5A and 5B illustrate nozzle arrangement.

The nozzle pitch is preferably set at a small value to increase the printing resolution. However, reduction of the clearance between the adjoining nozzles is difficult in some cases due to the design limitation. Thus, the nozzles may be disposed in a staggered shape as illustrated in FIG. 5A. In the following description, for simplifying the explanation, a structure having nozzles arranged in a staggered shape as illustrated in FIG. 5A is assumed to be the same structure as a structure having nozzles disposed in a line as illustrated in FIG. 4B.

According to the line printer, nozzle rows having a length equivalent to the sheet width need to be prepared. However, extension of the length of the nozzle rows is difficult in some cases due to design limitation. Thus, as illustrated in FIG. 5B, the nozzle rows may be attached to each other to produce a length equivalent to the sheet width. In the following description, for simplifying the explanation, a structure having nozzles attached to each other as illustrated in FIG. 5B is assumed to be the same structure as a structure having nozzles disposed in a line as illustrated in FIG. 4B.

Restriction by Cross Talk between Nozzles

The nozzle rows in this embodiment have a nozzle pitch of as small as 1/1600 inch. According to the structure that supplies ink from a supply path to a number of nozzles in the nozzle rows having this nozzle pitch, that is, a structure having a common supply path, ink delivery from one nozzle may affect nozzles disposed adjacent to the one nozzle (adjoining nozzles). For example, ink delivery from the nozzle #2 may influence ink delivery from the nozzle #1 and the nozzle #3. This effect may be caused by the ink pressure change in the nozzle #2 produced at the time of ink delivery from the nozzle #2 and transmitted to the nozzles #1 and #3. Another possible reason is that ink supply to the nozzle #2 affects ink supply to the nozzles #1 and #3. This mutual effect given to the adjoining nozzles is called "cross talk between nozzles".

The ink quantity from one nozzle at the time of ink delivery thus may change depending on whether the adjoining nozzle delivers ink or not due to the cross talk between the nozzles. For example, while ink drops having a desired size are delivered from the nozzle #2 at the time of no ink delivery from the nozzles #1 and #3, excessively small ink drops may be delivered from the nozzle #2 at the time of ink delivery from the nozzles #1 and #3.

According to this embodiment, therefore, ink delivery from adjoining nozzles is stopped at the time of ink delivery from one nozzle.

Dot Forming Method in the First Embodiment

Cyan

FIG. 6 illustrates a dot forming method according to a first embodiment of the invention. In FIG. 6, attention is given only to cyan, and the nozzle rows for the other colors are not shown. In the following description, "cyan" is not referred to when distinction from other colors is not particularly required. For example, the "dark cyan nozzle row" is simply referred to as "dark nozzle row" in some cases.

A dark nozzle row (C) and a light nozzle row (LC) are shown in the upper area of FIG. 6. Dots formed on pixels disposed in a square grid shape are shown in the lower part of FIG. 6. The hatched dots represent dark dots. The dark dots are formed by dark ink delivered from the dark nozzle row. The dots that are not hatched represent light dots. The light dots are formed by light ink delivered from the light nozzle row.

FIG. 6 shows a condition where the largest number of dots are formed for the convenience of explanation of dot arrangement. Thus, when dots are formed in the manner shown in FIG. 6, the gradient (concentration) of cyan represented by dark cyan dots and light cyan dots corresponds to the highest gradient. In fact, the gradient of cyan differs according to images to be printed, and some dots are not formed depending on the gradient of cyan.

The formation of dots (raster) arranged in the sheet width direction is initially explained.

When a raster having an odd number comes to a position opposed to the dark nozzle row (C), dark ink is delivered from the nozzles having odd numbers in the dark nozzle row to form dark dots on pixels having odd numbers. For example, when the first raster is opposed to the dark nozzle row (C), dark ink is delivered from nozzles having odd numbers such as the nozzles #1, 3 and 5 to form dark dots on pixels having odd numbers. When a raster having an even number is opposed to the dark nozzle row (C), dark ink is delivered from the nozzles having even numbers in the dark nozzle row to form dark dots on pixels having even numbers. For example, when the second raster comes to a position opposed to the dark nozzle row (C), dark ink is delivered from nozzles having even numbers such as the nozzles #2, 4 and 6 to form dark dots on the pixels having even numbers. Thus, ink is delivered from either odd number nozzles or even number nozzles, and ink delivery is stopped from the other number nozzles. Since ink is not delivered from the adjoining nozzles, the problem of cross talk between nozzles is prevented.

When a raster having an odd number comes to a position opposed to the light nozzle row (LC), light ink is delivered from the nozzles having even numbers in the light nozzle row to form light dots on pixels having even numbers. For example, when the first raster comes to a position opposed to the light nozzle row (LC), light ink is delivered from nozzles having even numbers such as the nozzles #2, 4 and 6 to form light dots on the pixels having even numbers. When a raster having an even number comes to a position opposed to the light nozzle row (LC), light ink is delivered from the nozzles having odd numbers in the light nozzle row to form light dots on pixels having odd numbers. For example, when the second raster comes to a position opposed to the light nozzle row (LC), light ink is delivered from nozzles having odd numbers such as the nozzles #1, 3 and 5 to form light dots on the pixels having odd numbers. Thus, in the case of the light nozzle row, ink is similarly delivered from either odd number nozzles or even number nozzles, and ink delivery is stopped from the other number nozzles. Since ink is not delivered from the adjoining nozzles, the problem of cross talk between nozzles is prevented.

Accordingly, for forming dots of a certain raster (dots arranged in the sheet width direction), the dark nozzle row forms a dark dot on every other pixel in the sheet width direction by stopping either the even number nozzles or odd number nozzles, and the light nozzle row forms a light dot on every other pixel in the sheet width direction by stopping the odd number nozzles or the even number nozzles such that each light dot can be disposed between the dark dots each formed on every other pixel in the sheet width direction. By this method, the dark dots and the light dots are formed alternately in the sheet width direction, and thus ink can be applied with no clearance produced.

When a dark dot and a light dot are overlapped on the same pixel, a blank pixel is produced for every other pixel, making it difficult to apply ink without clearance. In this case, the base of the sheet is visible even when throughout application of cyan is desired.

Formation of dots arranged in the feed direction is now described.

The nozzles having odd numbers in the dark nozzle row (C) deliver dark ink every time these nozzles are opposed to a raster having an odd number to form a dark dot on every other pixel in the feed direction. For example, the nozzle #1 delivers dark ink every time the nozzle #1 comes to a position opposed to the 1st, 3rd, 5th, or other odd number raster to form a dark dot on every other pixel in the feed direction. Thus, the nozzles having odd numbers form dark dots on the pixels of an odd number raster, and do not form dots on the pixels of an even number raster opposed to the nozzles next. Nozzles having even numbers in the dark nozzle row (C) deliver dark ink every time these nozzles are opposed to a raster having an even number to form a dark dot on every other pixel in the feed direction. For example, the nozzle #2 delivers dark ink every time the nozzle #2 comes to a position opposed to the 2nd, 4th, 6th, or other even number raster to form a dark dot on every other pixel in the feed direction. Thus, nozzles having even numbers form dark dots on the pixels of an even number raster, and do not form dots on the pixels of an odd number raster opposed to the nozzles next.

Nozzles having odd numbers in the light nozzle row (LC) deliver light ink every time they are opposed to a raster having an even number to form a light dot on every other pixel in the feed direction. For example, the nozzle #1 delivers light ink every time the nozzle #1 comes to a position opposed to the 2nd, 4th, 6th, or other even number to form a light dot on every other pixel in the feed direction. Thus, nozzles having odd numbers form light dots on the pixels of an even number raster, and does not form dots on the pixels of an odd number raster opposed to the nozzles next. Also, nozzles having even numbers in the light nozzle row (LC) deliver light ink every time they are opposed to a raster having an odd number to form a light dot on every other pixel in the feed direction. For example, the nozzle #2 delivers light ink every time the nozzle #2 comes to a position opposed to the 1st, 3rd, 5th, or other odd number raster to form a light dot on every other pixel in the feed direction. Thus, nozzles having even numbers form light dots on the pixels of an odd number raster, and do not form dots on the pixels of an even number raster opposed to the nozzles next.

According to the formation of dots arranged in the feed direction, therefore, the dark nozzles form a dark dot on every other pixel, and the light nozzles form a light dot on every other pixel such that each light dot is located between the dark dots each formed on every other pixel in the feed direction. By this arrangement, dark dots and light dots are alternately disposed in the feed direction, allowing ink to be applied without clearance.

There is a limit to a period for successively delivering ink drops from nozzles (delivery period) due to design limitation of the nozzles. When dots are formed on pixels disposed successively in the feed direction, the sheet is shifted for a distance equivalent to only one pixel during the delivery period. In this case, the feeding speed lowers, and the printing speed lowers accordingly. According to the first embodiment, however, the respective nozzles form a dot on every other pixel in the feed direction. In this case, the sheet is shifted for a distance equivalent to two pixels during the delivery period, and thus the printing speed increases.

According to the first embodiment, the size of each dark dot is larger than that of each light dot for the following reason.

The light dots are formed originally for the purpose of displaying light color with smooth gradient. Thus, when the light dots are large, each particle of the light dots becomes conspicuous in the light part of the printing image and produces an undesirable image. It is therefore preferable that the size of the light dots is small. On the other hand, when the dark dots are small, the color obtained when dots are formed on all pixels becomes relatively light. It is more preferable, however, that deep and dark color is produced when dots are formed on all pixels in view of gradient display with rich color. Accordingly, the size of each dark dot is made larger than the size of each light dot in the first embodiment.

According to the first embodiment, therefore, the dark dots are formed in a checkered pattern, and the light dots are similarly formed in a checkered pattern such that each light dot is located between the dark dots arranged in the checkered pattern as illustrated in FIG. 6. Thus, dark dots and light dots are formed with no clearance produced, and thus the color material of the ink can be applied throughout the sheet without clearance.

According to the first embodiment, the dark dots and the light dots are alternately disposed to display the gradient of cyan with no overlap between the dark dots and light dots. Thus, the variation in concentration of cyan in accordance with the quantity of supplied ink becomes greater in the first embodiment than that in a structure overlapping dark dots with light dots (such as in a comparison example to be described later). As a result, the quantity of supplied ink (delivery quantity) at the time of printing an image can be decreased.

Ink in Colors Other than Cyan

A dark nozzle row (M) and a light nozzle row (LM) are similarly prepared for magenta (see FIGS. 4A and 4B). Thus, advantages similar to those in case of cyan can be provided by forming dots using the dark nozzle row (M) and the light nozzle row (LM) for magenta in the same manner as in case of the dark nozzle row (C) and the light nozzle row (LC) for cyan described above. In other words, advantages similar to those in the case of cyan can be offered by disposing dark dots and light dots of magenta in the same manner as are the dark dots and light dots of cyan described above.

The pixels on which the light dots of magenta are formed are preferably different from the pixels on which the light dots of cyan are formed. More specifically, the light dots of cyan are preferably disposed in a checkered pattern, and the light dots of magenta are preferably similarly formed in a checkered pattern such that each light dot of magenta can be disposed between the light dots of cyan formed in the checkered pattern. By this arrangement, the light dots of cyan and the light dots of magenta are dispersed in the light part of the printing image. Thus, the particles of the printing image become inconspicuous, and the image quality improves.

As for yellow, dark ink and light ink having different concentrations are not separately delivered. This is because the problem of conspicuousness of particles does not occur due to the fact that dots of yellow are not noticeable when compared with those of cyan and magenta. (In the case of cyan and magenta, dots are noticeable and the problem of particles easily occurs. Thus, light ink is prepared for those colors.) Accordingly, only one nozzle row for delivering yellow is provided (see FIGS. 4A and 4B).

The nozzle row (Y) of yellow forms dots in a checkered pattern. In this case, during ink delivery from one nozzle, delivery of ink from the adjoining nozzles is stopped. Thus, the problem of cross talk between the nozzles is prevented. Since each of the nozzles forms a dot on every other pixel in the feed direction, the sheet is shifted for a distance equivalent to two pixels during the delivery period. Accordingly, the printing speed increases.

Second Embodiment

Figure 7:
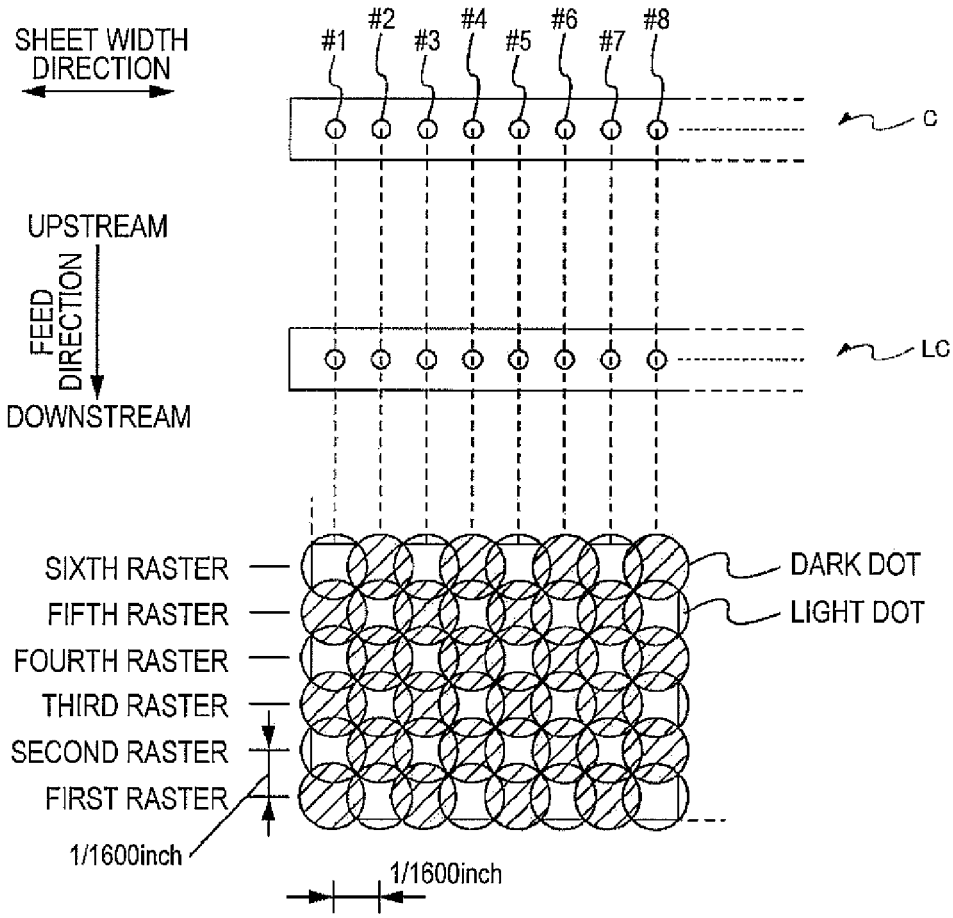
FIG. 7 illustrates a dot formation method according to a second embodiment of the invention.

FIG. 7 illustrates a dot forming method according to a second embodiment of the invention. The second embodiment is different from the first embodiment in that the size of each dark dot is equal to that of each light dot. Other points are approximately the same as in the first embodiment, and the explanation of these same points is not repeated herein.

According to the second embodiment, the size of each dark dot is equal to the size of each light dot. Thus, the particles become conspicuous when the size of the light dots is relatively large. When the size of each dark dot is relatively small, deep and dark color cannot be easily displayed. In the second embodiment, therefore, it is difficult to achieve both reduction of conspicuousness of particles in the light part of the printing image and representation of the deep and dark part of the printing image compared with the first embodiment.

However, in the second embodiment, similar to the first embodiment, each dark nozzle forms a dark dot on every other pixel in the sheet width direction while stopping delivery from even number nozzles or odd number nozzles, and each light nozzle forms a light dot on every other pixel in the sheet width direction while stopping delivery from odd number nozzles or even number nozzles such that each light dot can be located between the dark dots each formed on every other pixel in the sheet width direction, at the time of formation of dots of a certain raster (at the time of formation of dots arranged in the sheet width direction). By this method, the dark dots and the light dots are alternately disposed in the sheet width direction, and thus ink can be applied without clearance produced.

Also in the second embodiment, similar to the first embodiment, each dark nozzle forms a dark dot on every other pixel, and each light nozzle forms a light dot on every other pixel in the sheet width direction such that each light dot can be located between the dark dots each formed on every other pixel in the feed direction, at the time of formation of dots arranged in the feed direction. By this method, the dark dots and the light dots are alternately disposed in the sheet width direction, and thus ink can be applied without clearance produced. Moreover, since each of the nozzles forms a dot on every other pixel in the feed direction, the sheet can be shifted for a distance equivalent to two pixels during the delivery cycle. As a result, the printing speed increases.

Third Embodiment

Figure 8:
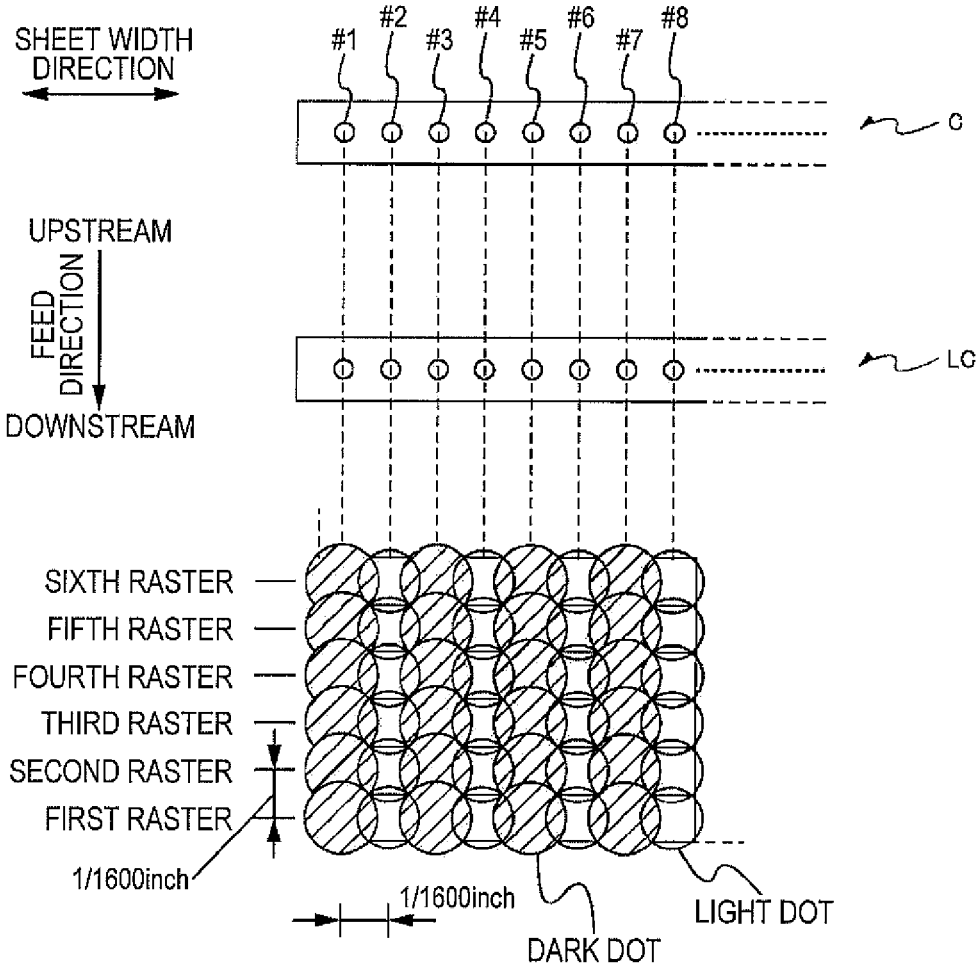
FIG. 8 illustrates a dot formation method according to a third embodiment of the invention.

FIG. 8 illustrates a dot formation method according to a third embodiment of the invention. The dot arrangement of the third embodiment is different from that in the first embodiment. Other points are approximately the same as in the first embodiment, and the explanation of these same points is not repeated herein.

When each raster comes to a position opposed to the dark nozzle row (C), nozzles having odd numbers in the dark nozzle row deliver dark ink to form dark dots on pixels having odd numbers. Also, when each raster comes to a position opposed to the light nozzle row (LC), nozzles having even numbers in the light nozzle row deliver light ink to form light dots on pixels having even numbers. Thus, ink is delivered from either the odd number nozzles or the even number nozzles, and ink is not delivered from the other nozzles. Since ink delivery from the adjoining nozzles is stopped, the problem of cross talk between the nozzles is prevented.

In the third embodiment, similar to the first and second embodiments, each dark nozzle forms a dark dot on every other pixel in the sheet width direction while stopping delivery from even number nozzles, and each light nozzle forms a light dot on every other pixel in the sheet width direction while stopping delivery from odd number nozzles such that each light nozzle forms a light dot between the dark dots each formed on every other pixel in the sheet width direction, at the time of formation of dots of a certain raster, (at the time of formation of dots arranged in the sheet width direction). By this method, the dark dots and the light dots are alternately disposed in the sheet width direction, and thus ink can be applied without clearance produced.

According to the third embodiment, however, the dark nozzles form dots on pixels disposed successively in the feed direction. Also, the light nozzles form dots disposed successively in the feed direction. In this case, the sheet is shifted for a distance equivalent to only one pixel during the delivery period. This lowers the feeding speed, and thus the printing speed in the third embodiment becomes lower than that in the first embodiment.

While dots are formed without clearance by alternately disposing dark dots and light dots in a checkered pattern in the first embodiment, each of the light dots disposed in a row in the feed direction is interposed between the dark dots disposed in a row (dark dot row) in the feed direction in the third embodiment. When it is assumed that the size of each dark dot in the first embodiment is the same as the size of each dark dot in the third embodiment, the size of each light dot required for applying ink without clearance needs to be larger in the third embodiment than that in the first embodiment. Thus, the conspicuousness of particles in the light part of the printing image is less reduced in the third embodiment than in the first embodiment.

COMPARISON EXAMPLE

Figure 9A:
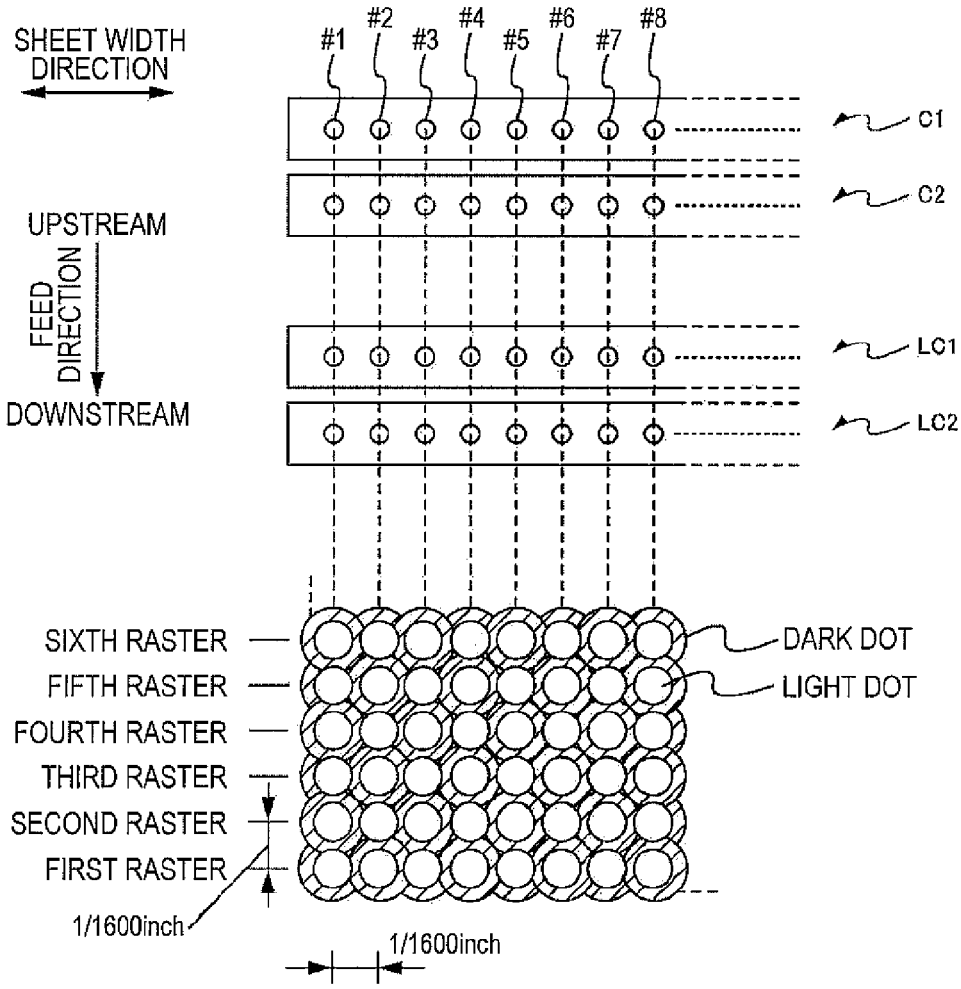
FIG. 9A illustrates a dot formation method according to a comparison example.
Figure 9B:
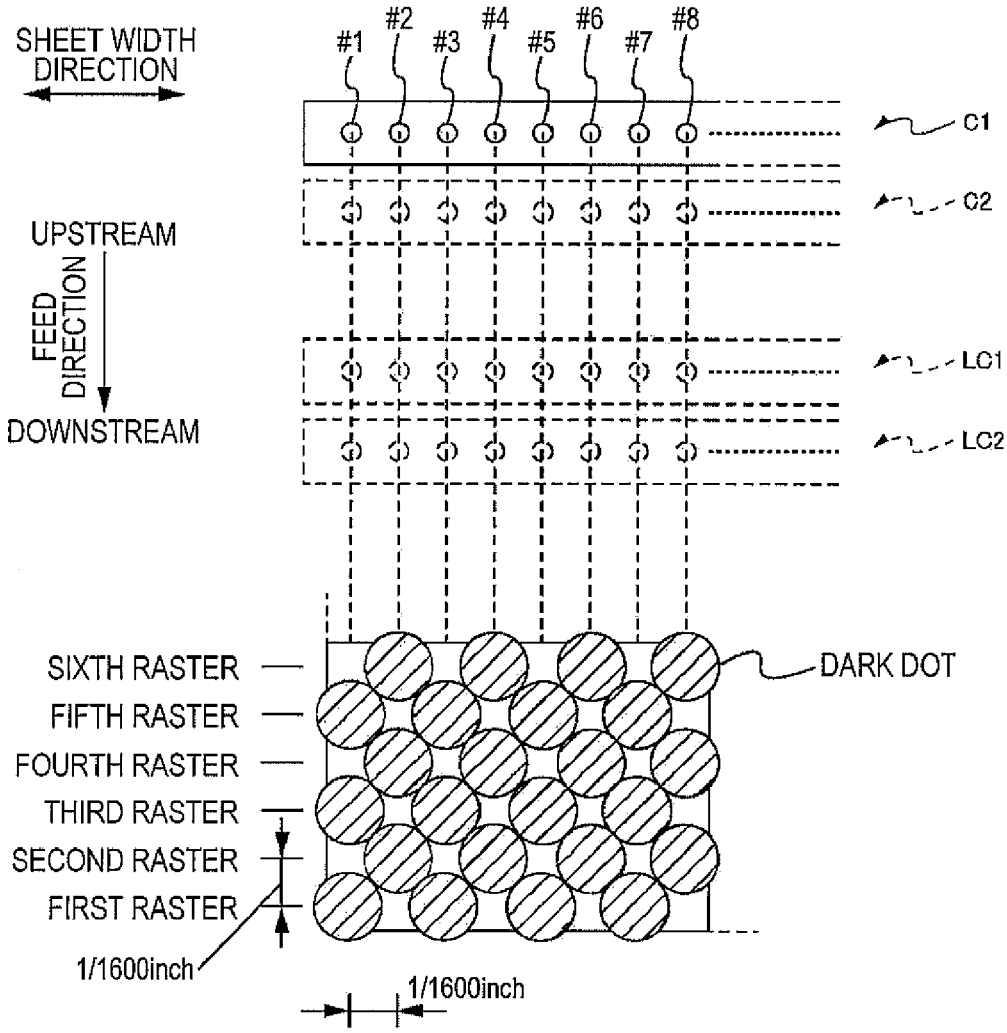
FIG. 9B illustrates a dark dot formation method according to the comparison example.
Figure 9C:
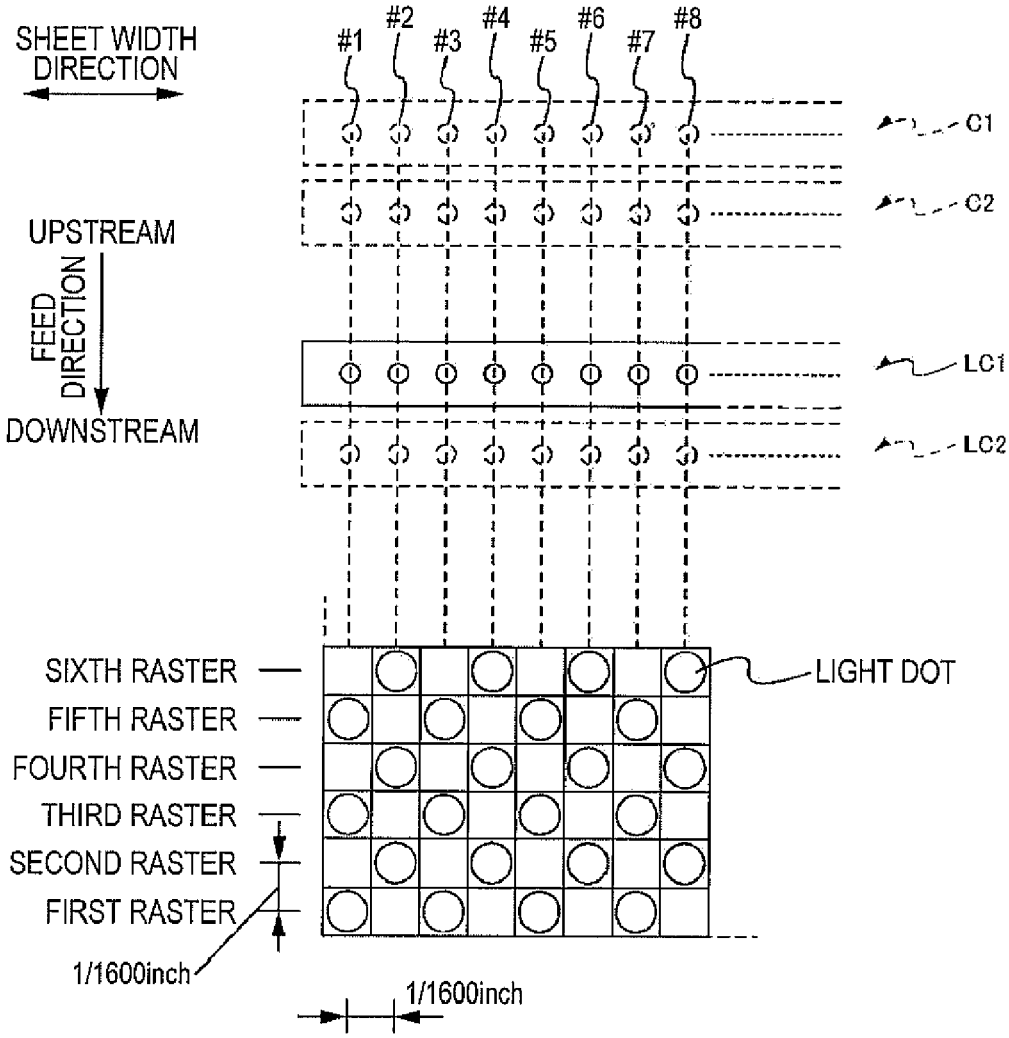
FIG. 9C illustrates a light dot formation method according to the comparison example.

FIG. 9A illustrates a dot formation method according to a comparison example. FIG. 9B shows a dark dot formation method in a comparison example. FIG. 9C shows a light dot formation method in a comparison example. Similar to the above embodiments, these figures show conditions where the largest number of dots are formed. Since dark dots and light dots are overlapped as will be described later in the comparison example, white dots as light dots are shown on hatched dark dots in FIG. 9A. While dark dots are smaller than light dots due to drawing restriction, the sizes of dark dots and light dots are actually the same in the comparison example.

The comparison example is different from the first through third embodiments in that two dark nozzle rows and two light nozzle rows are provided (one dark nozzle row and one light nozzle row are provided in the first through third embodiments). In the comparison example, one of the two dark nozzle rows is called a first dark nozzle row (C1), and the other dark nozzle row is called a second dark nozzle row (C2). Similarly, in the comparison example, one of the two light nozzle rows is called a first light nozzle row (LC1), and the other light nozzle row is called a second light nozzle row (LC2).

In the comparison example, dark dots and light dots are overlapped on all pixels when the largest number of dots are formed (when the gradient (concentration) of cyan is the highest gradient). For forming dots in this manner, two dark nozzle rows are used to form dark dots on all pixels in the comparison example. More specifically, the first dark nozzle row (C1) forms dark dots in a checkered pattern as illustrated in FIG. 9B, and the second dark nozzle row (C2) forms dark dots on the remaining pixels of the checkered pattern. Similarly, two light nozzle rows are used to form light dots on all pixels in the comparison example. More specifically, the first light nozzle row (LC1) forms light dots in a checkered pattern as illustrated in FIG. 9C, and the second light nozzle row (LC2) forms light dots on the remaining pixels of the checkered pattern.

According to the comparison example, ink can be applied without clearance produced. However, since two dark nozzle rows and two light nozzle rows are required in the comparison example, the number of nozzle rows included in the head unit increases. As a result, the manufacturing cost is higher than in the first through third embodiments.

According to the comparison example, dots in the same color (cyan in this example) are overlapped on the same pixel. When the colors of the dark ink and light ink in the first embodiment and in the comparison example are respectively controlled such that the cyan concentration at the time of dot formation as illustrated in FIG. 9A becomes equal to the cyan concentration at the time of dot formation as illustrated in FIG. 6, the concentration variation of cyan in accordance with the quantity of supplied ink is smaller in the comparison example than in the first embodiment. As a result, a larger delivery quantity of cyan ink in printing the image is required in the comparison example than in the first through third embodiments.

OTHER EXAMPLES

While the printer and other elements as an example have been discussed herein, these examples are given not for limiting the invention but only for easy understanding of the invention. Various modifications and improvements may be made without departing from the scope and spirit of the invention, and equivalents of those are thus encompassed by the invention. Particularly, the following examples are included within the scope of the invention.

Line Printer

According to the embodiments described herein, a line printer delivers ink from nozzle rows having the same length as that of a sheet on which an image is printed while shifting the sheet. However, the same technologies described in these embodiments are applicable to other types of printers.

Figure 10A:
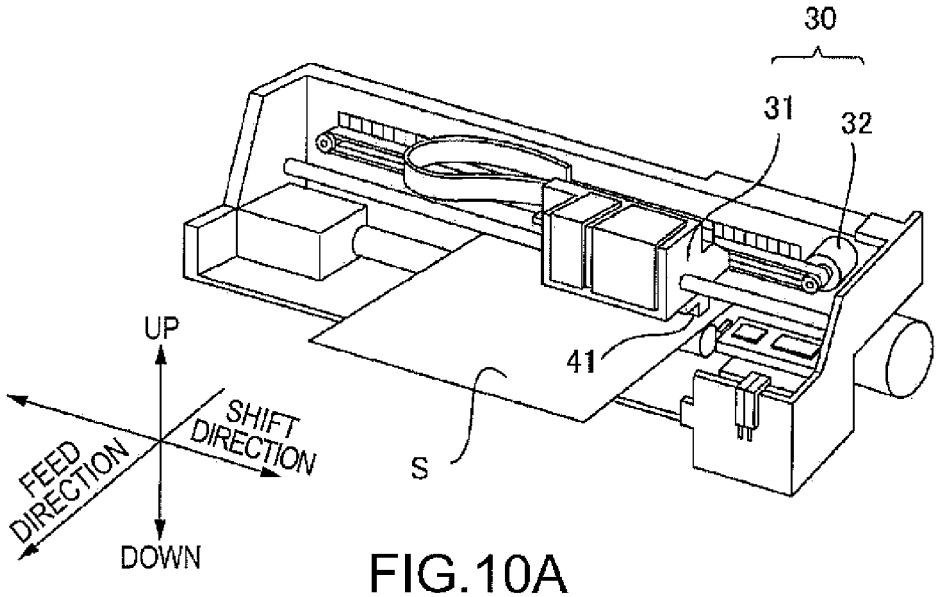
FIG. 10A illustrates another type of printer.

FIG. 10A illustrates another type of printer. This printer includes a carriage unit 30 having a carriage 31 and a carriage motor 32. A head 41 is provided under the carriage.

Figure 10B:
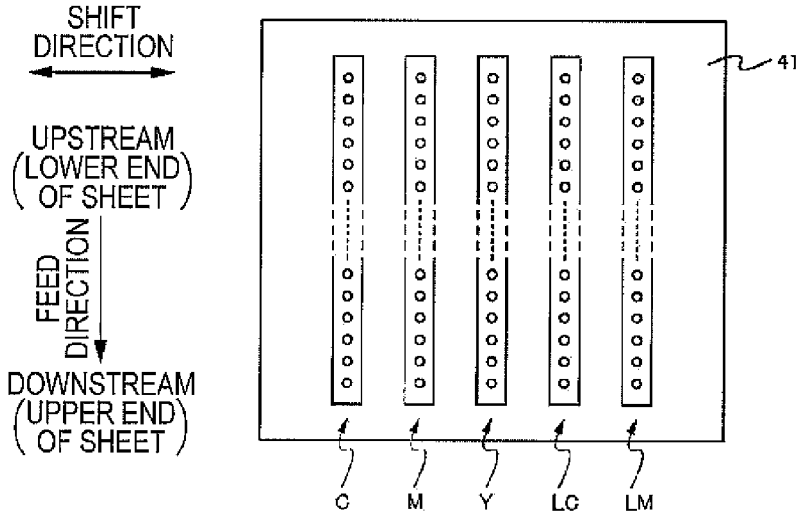
FIG. 10B illustrates a plurality of nozzle rows arranged on a lower surface of a head of the printer of FIG. 10A as viewed from above through the lower surface.

FIG. 10B illustrates a plurality of nozzle rows arranged on the lower surface of the head 41 from above through the lower surface. Five nozzle rows are disposed on the lower surface of the head 41 in the shift direction. Each of the nozzle rows has a plurality of nozzles with a predetermined pitch in the feed direction.

A controller (not shown) of the printer alternately repeats a dot forming operation for delivering ink from the nozzle rows which shift in the shift direction and a feeding operation for feeding a sheet in the feed direction by controlling a feed unit and a head unit having the carriage unit 30 and the head 41 so as to perform printing.

Figure 11:
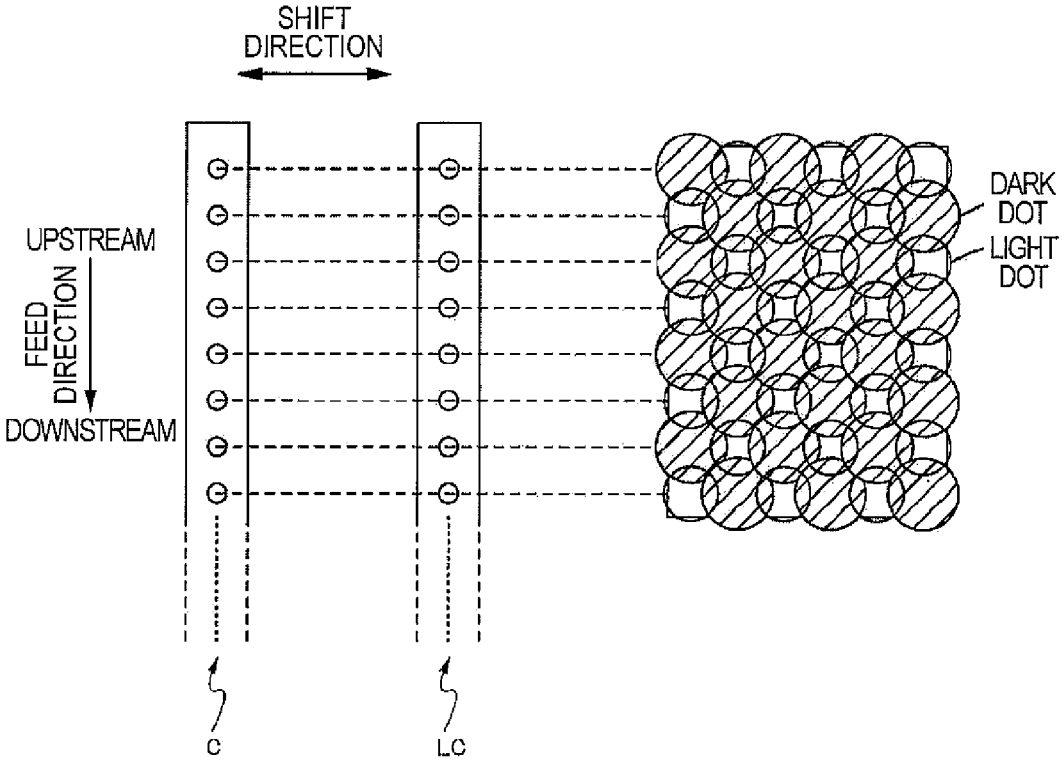
FIG. 11 illustrates a dot formation method performed by the printer of FIG. 10A.

FIG. 11 illustrates a dot formation method which uses this printer. FIG. 11 shows the dot forming operation performed during the feeding operation. As illustrated in FIG. 11, dark dots are formed in a checkered pattern, and light dots are similarly formed in a checkered pattern such that each light dot can be disposed between the dark dots formed in the checkered pattern. This example provides advantages similar to those in the first embodiment.

Positional Relation between Light Dots of Cyan and Magenta

According to the above embodiments, pixels on which light dots of magenta are formed are different from pixels on which light dots of cyan are formed. However, the pixels of the light dots of magenta and the pixels of the light dots of cyan may be the same. In this case, conspicuousness of particles does not increase even when the positions of the light dots are shifted from the desired positions.

When the pixels of the light dots of magenta and the pixels of the light dots of cyan are the same, dark dots of magenta and dark dots of cyan are formed on the same pixels. In this case, the pixels on which yellow dots are formed are preferably the same as the pixels on which the dark dots of cyan and magenta are formed. According to this arrangement, light dots of cyan and magenta are disposed on pixels where yellow dots are not formed, and thus color deviation becomes unnoticeable. When light dots of cyan and magenta are disposed on the pixels where yellow dots are formed, dark dots of cyan and magenta are located on pixels where yellow dots are not formed. Thus, color deviation becomes conspicuous.

Liquid Delivery Device

While an ink jet type printer has been discussed as an example of a liquid delivery device for delivering liquid in the above embodiments, the liquid delivery device is not limited to this type of printer. For example, the technologies according to these embodiments are applicable to color filter manufacturing devices, coloring devices, minute processing devices, semiconductor manufacturing devices, surface processing devices, three-dimensional molding devices, liquid vaporizing devices, organic EL manufacturing devices (particularly high-molecular EL manufacturing devices), display manufacturing devices, film forming devices, DNA chip manufacturing devices, and other various types of liquid delivery devices that use ink jet technology. Manufacturing methods and other methods associated with these devices are included within the scope of the invention.

Nozzle

While ink is delivered by using heaters according to the above embodiments, the method for delivering liquid is not limited to this method. For example, ink may be delivered by using a piezoelectric element or by other methods.

What is claimed is:

1. A liquid delivery device, comprising:

a first nozzle row that has a plurality of nozzles in a predetermined direction and delivers first liquid;

a second nozzle row that has a plurality of nozzles in the predetermined direction and delivers a second liquid having a concentration different from that of the first liquid; and a controller that forms first dots on a medium at predetermined intervals by delivering the first liquid from the plural nozzles of the first nozzle row without using a part of the nozzles of the first nozzle row, and forms second dots on the medium at the predetermined intervals by delivering the second liquid from the plural nozzles of the second nozzle row without using a part of the nozzles of the second nozzle row such that each of the second dots is located between the first dots in the predetermined direction.

2. The liquid delivery device according to claim 1, wherein;

when liquid is delivered from one nozzle, liquid is not delivered from nozzles disposed adjacent to the one nozzle.

3. The liquid delivery device according to claim 1, wherein:

when one nozzle forms a dot on a pixel, the one nozzle does not form a dot on a pixel opposed to the one nozzle next.

4. The liquid delivery device according to claim 3, wherein:

when the first dot is formed on a pixel by one nozzle of the first nozzle row, the second dot is formed on a pixel opposed to the one nozzle next.

5. The liquid delivery device according to claim 1, wherein:

the first liquid is darker than the second liquid; and the first dots are larger than the second dots.

6. The liquid delivery device according to claim 1, wherein:

when the darkest color is represented by the first liquid and the second liquid, both the first dots and the second dots are disposed in a checkered pattern such that each second dot is not formed on a pixel where the first dot is formed.

7. The liquid delivery device according to claim 1, wherein:

the first nozzle row delivers dark cyan ink to form dark cyan dots on the medium;

the second nozzle row delivers light cyan ink to form light cyan dots on the medium; and the liquid delivery device has a third nozzle row that delivers dark magenta ink to form dark magenta dots on the medium, and a fourth nozzle row that delivers light magenta ink to form light magenta dots on the medium;

each of the light magenta dots is disposed between the light cyan dots.

8. A liquid delivery method, comprising:

delivering a first liquid from a first nozzle row that has a plurality of nozzles in a predetermined direction;

delivering a second liquid having a concentration different from that of the first liquid from a second nozzle row that has a plurality of nozzles in the predetermined direction; and forming first dots on a medium at predetermined intervals by delivering the first liquid from the plural nozzles of the first nozzle row without using a part of the nozzles of the first nozzle row; and forming second dots on the medium at the predetermined intervals by delivering the second liquid from the plural nozzles of the second nozzle row without using a part of the nozzles of the second nozzle row such that each of the second dots is located between the first dots in the predetermined direction.

* * * * *